United States Patent [19]

Simpson

[11] 3,941,355

[45] Mar. 2, 1976

[54] MIXING INSERT FOR FOAM DISPENSING APPARATUS

[75] Inventor: William G. Simpson, Huntsville, Ala.

[73] Assignee: The United States of America as represented by the Administrator of the National Aeronautics and Space Administration, Washington, D.C.

[22] Filed: June 12, 1974

[21] Appl. No.: 478,800

[52] U.S. Cl. ..... 259/4 AC; 222/145

[51] Int. Cl.[2] ..... B01F 15/00; B67D 5/60

[58] Field of Search ..... 222/145; 259/4, 18, 36, 259/95, 4 R, 4 A, 4 AB, 4 AC; 138/42

[56] References Cited

UNITED STATES PATENTS

| | | | |
|---|---|---|---|
| 2,802,648 | 8/1957 | Christensen et al. | 259/4 |
| 3,190,618 | 6/1965 | Katzen | 259/4 |
| 3,361,412 | 1/1968 | Cole | 259/4 |
| 3,466,149 | 9/1969 | Blood et al. | 259/4 X |

FOREIGN PATENTS OR APPLICATIONS

| | | | |
|---|---|---|---|
| 55,970 | 12/1935 | Norway | 138/42 |

*Primary Examiner*—Allen N. Knowles
*Assistant Examiner*—Hadd Lane
*Attorney, Agent, or Firm*—Wayland H. Riggins; L. D. Wofford, Jr.; John R. Manning

[57] ABSTRACT

A device for mixing foam ingredients. The device comprises an arrangement of lands situated about a cylindrical elongated shaft-like member with each land having a slot therein. The slots of alternate lands are positioned 180° from each other so that as the ingredients flow through the mixing chamber it flows from adjacent one side of the housing to the other dividing as such passes around the shaft-like member.

1 Claim, 3 Drawing Figures

MIXING INSERT FOR FOAM DISPENSING APPARATUS

ORIGIN OF THE INVENTION

The invention described herein was made by an employee of the U.S. Government and may be manufactured and used by or for the Government for governmental purposes without the payment of any royalties thereon or therefor.

BACKGROUND OF THE INVENTION

The present invention relates to a mixing device and more particularly to a device for mixing two component materials of high viscosity such as the components utilized to produce a polyurethane foam.

It is well known that thorough mixing of properly proportioned foam ingredients is essential in order that the foam have consistent and uniform properties throughout.

Devices have been developed for insuring that a homogeneous mixture is produced when combining two or more ingredients of high viscosity. One such device is disclosed in U.S. Pat. No. 3,361,412 granted to A. Cole, III on Jan. 2, 1968. This device discloses a foam mixing head which utilizes a plurality of lands longitudinally spaced within a mixing chamber with slots provided therein which alternate between adjacent lands. Such causes the mixture to take a circuitous path through the mixing chamber as the mixture flows therethrough. As can be seen in the Cole patent, the mixture merely follows a substantially sinusoidal path as it flows through the mixing chamber. While in some instances, such may be satisfactory for insuring that ingredients are completely mixed, it is often desirable to have a more thorough and tortuous mixing action.

SUMMARY OF THE INVENTION

The invention includes an apparatus for mixing ingredients which are normally in a fluid state for producing foam. The apparatus includes an elongated housing having a cylindrical bore extending therethrough. A mixing insert is carried within the cylindrical bore and includes an elongated shaft-like member. A series of longitudinally spaced radially extending discs or lands are carried on the shaft-like member. Each of the discs has a slot extending from an outer periphery thereof for passing the ingredients therethrough. The slots of alternate discs are positioned 180° from each other. Means is provided for supplying the ingredients through the elongated housing whereby the ingredients flow from adjacent one side of the housing to the other as it flows through the slots of alternate discs with the ingredients dividing as such flows around the shaft-like member and recombining before passing through the next slot.

Accordingly, it is an object of the present invention to provide an improved mixing insert for a foam dispensing apparatus which provides a more thorough mixing of ingredients.

Another important object of the present invention is to provide a mixing insert of simple, unitary construction which allows a foam dispensing device to be more easily cleaned following the operation thereof.

Still another important object of the present invention is to provide an insert for a foam dispensing apparatus which causes ingredients to flow through a tortuous path. Such also causes the mixture to be divided and recombined to insure complete mixing thereof.

These and other objects and advantages of the invention will become apparent upon reference to the following specification, attendant claims, and drawing.

DESCRIPTION OF THE PREFERRED EMBODIMENT

Figure 1:
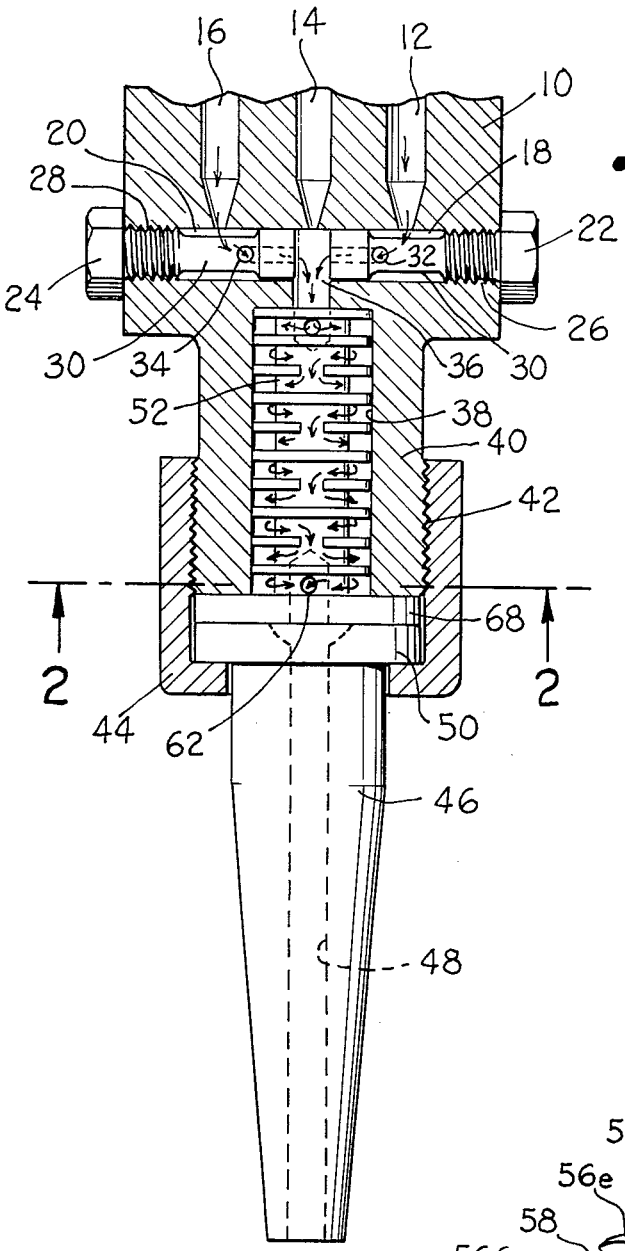
FIG. 1 is a side, elevational view partially in section illustrating a mixing insert carried within a foam dispensing apparatus.
Figure 2:
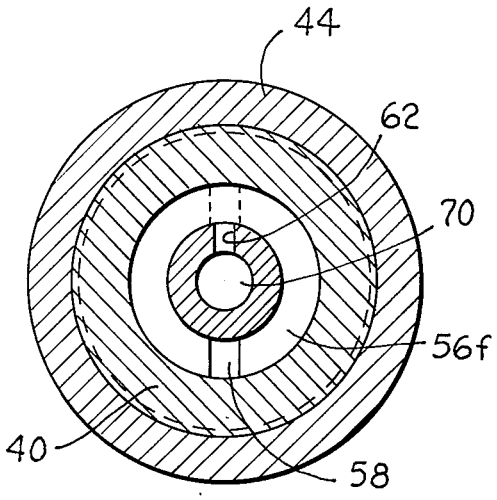
FIG. 2 is a sectional view taken along line 2—2 of FIG. 1.

Referring in more detail to FIG. 1, there is illustrated a portion of a conventional foam dispensing gun which includes a housing 10 having three passages 12, 14 and 16 extending therethrough. The passages 12 and 16 are utilized for the insertion of the foam ingredients into the gun. A solvent usually flows through the passage 14 for cleaning the gun 10. All of the passages 12, 14 and 16 are provided with suitable valving mechanisms, not shown, for controlling the flow of the ingredients and solvents therethrough.

The passages 12 and 16 terminate in laterally extending bores 18 and 20, respectively. Provided in the bores 18 and 20 are bolts 22 and 24 which have threaded portions 26 and 28, respectively. Intermediate portions 30 of the bolts 22 and 24 have reduced diameters so as to provide a chamber between the walls of the transverse bores 18 and 20 and the walls of the bolts 22 and 24. A passage 32 extends from the intermediate portion of the bolt 22 along the axis thereof into a longitudinal chamber 36 provided between the inner ends of the bolts 22 and 24. The bolt 24 has a similar passage 34 extending therethrough. As the ingredients pass through the passages 12 and 16, through the passages 32 and 34, they are mixed in the longitudinal chamber 36. The majority of the mixing of the ingredients takes place in this chamber; however, in order to insure complete and homogeneous mixing of the ingredients, additional mixing takes place as the ingredients pass outwardly through the gun.

An enlarged, elongated cylindrical bore 38 is provided within a cylindrical end portion 40 of the housing 10. External threads 42 are provided thereon for accommodating a rotatable nut 44 which is used for securing a nozzle 46 to the end of the cylindrical housing 40. The nozzle 46 has a longitudinal passage 48 extending therethrough which terminates in a radially extending flange 50. The rotatable nut engages the flange 50 for securing such to the barrel of the gun.

Figure 3:
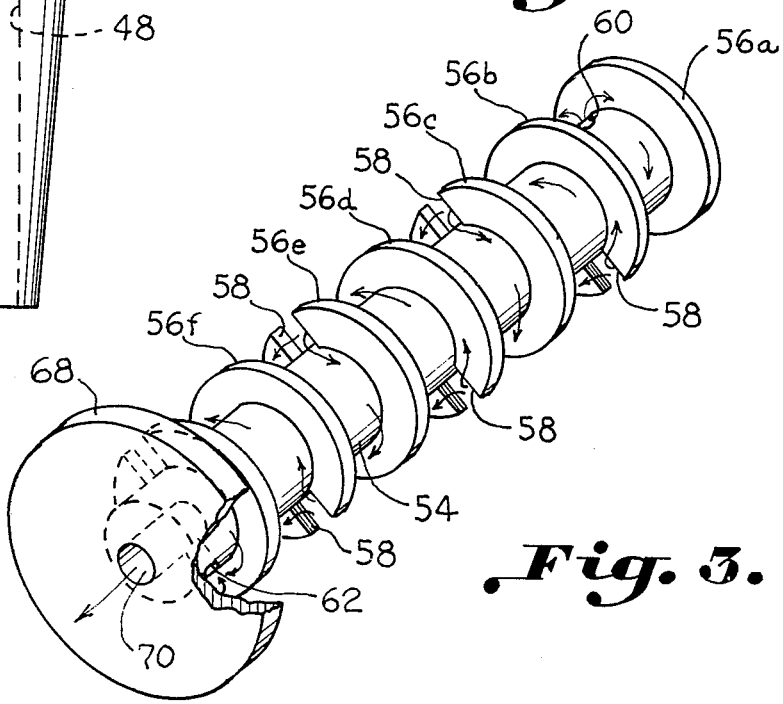
FIG. 3 is an enlarged, perspective view illustrating an insert constructed in accordance with the present invention.

A mixing insert 52 is carried within the cylindrical bore for insuring complete mixing of the ingredients flowing through the gun. The mixing insert includes an elongated, metallic shaft-like member 54 which has a plurality of longitudinally spaced radially extending discs, or lands **56*a* through 56*f* provided thereon. Each of the discs 56*b* through 56*f* has a radially extending slot 58 provided therein which extends from the periphery of the shaft-like member 54 to the outer periphery of the disc. As can be seen in FIG. 3, the slots of alternate discs 56*b* through 56*f*** are spaced 180° from each other.

In order to permit the ingredients from the mixing chamber 36 to flow into the mixing insert 52 an inlet passage 60 extends along the longitudinal axis of the shaft-like member 54 through the periphery thereof so that the mixture flows from the chamber 36 into the area between the first disc 56*a* and the second disc 56*b*. An exit passage 62 is provided between the last disc 56*f* and an enlarged flange 68 carried on the shaft-like member 54. Such is to permit the mixture to flow from the mixing insert 52 out a longitudinal bore 70 through the passage 48 provided in the nozzle 46.

In summarizing the operation of the foam dispensing gun, the ingredients which are to be mixed to produce the foam are fed through the passages 12 and 16 into the first mixing chamber 36 wherein a primary mixing action takes place. The mixed ingredients then are fed through the passage 60 intermediate the lands 56*a* and 56*b*. The mixture then divides with a portion going clockwise around the shaft-like member 54 and the remainder going counter-clockwise until such reaches the slot 58 provided in the disc shaped member 56*b* 180° from the inlet passage 60. At this point, the mixture is recombined and then divides again as such is fed to the slot 58 provided in the disc 56*c*. This torturous and circuitous action continues until the mixture reaches the outlet passage 62. At this stage, the ingredients are completely mixed as a result of the flow stream undergoing a plurality of changes in flow direction. As can be seen, such mixing takes place without any moving mechanical parts.

After the mixing gun has been utilized, in order to clean the apparatus, the nut 44 is screwed off the barrel 40 and the nozzle 46 removed therefrom. The insert 52 can be removed from the longitudinal bore for cleaning. Solvent can be supplied through the passage 14 for cleaning the intermediate chamber 36.

While a preferred embodiment of the invention has been described using specific terms, such description is for illustrative purposes only, and it is to be understood that changes and variations may be made without departing from the spirit or scope of the following claim.

What is claimed is:

1. An apparatus for mixing ingredients in a fluid state for producing foam comprising:

an elongated housing having a cylindrical bore extending therethrough;

a mixing insert being unitary and carried within said cylindrical bore;

said mixing insert including an elongated shaft-like member;

a series of longitudinally spaced radially extending discs carried on said shaft-like member;

the outer diameter of each of said discs corresponding to the diameter of said bore;

each of said discs having a slot extending from an outer periphery of said disc for fluid passage therethrough;

said slots of alternate discs being positioned substantially 180° from each other;

the entire space around said shaft-like member between said discs being unobstructed whereby said ingredients may flow around said shaft-like member in either direction;

means for supplying said ingredients into said elongated housing whereby said ingredients flow from one end of said housing to the other thereof as it flows through said slots of alternate discs with said ingredients being divided and recombined as it flows around said shaft-like member;

an inlet passage for said ingredients extending axially from one end of said shaft-like member and laterally through the periphery of said shaft-like member into the space between the first two discs at said one end of said shaft-like member;

an outlet passage for said ingredients at the other end of said shaft-like member beyond the last of said slotted discs extending laterally to the center of said shaft-like member and axially out of said other end of said shaft-like member.

* * * * *